US007446286B2

(12) United States Patent
Reithofer et al.

(10) Patent No.: US 7,446,286 B2
(45) Date of Patent: Nov. 4, 2008

(54) HEATER STRIP FOR AN ELECTRIC HEATER, HEATER WITH SUCH A HEATER STRIP AND METHOD FOR MANUFACTURING THE HEATER STRIP

(75) Inventors: Josef Reithofer, Wolfpassing bei Zeiselmauer (AT); Christian Auradnik, Klosterneuburg (AT)

(73) Assignee: Electrovac AG, Klosterneuburg (AT)

( * ) Notice: Subject to any disclaimer, the term of this patent is extended or adjusted under 35 U.S.C. 154(b) by 35 days.

(21) Appl. No.: 11/486,424

(22) Filed: Jul. 14, 2006

(65) Prior Publication Data

US 2007/0023415 A1 Feb. 1, 2007

(30) Foreign Application Priority Data

Aug. 1, 2005 (DE) ..... 10 2005 036 581

(51) Int. Cl.
*H05B 3/06* (2006.01)
*H01C 1/03* (2006.01)

(52) U.S. Cl. ..... 219/542; 219/444.1; 219/465.1; 219/467.1; 219/468.1; 219/468.2; 219/448.17; 219/451.1; 219/452.12; 219/453.12; 219/453.15; 219/460.1; 219/461.1; 219/541; 219/544; 219/552; 219/553; 338/322; 338/323; 338/324; 338/240; 338/241; 338/326; 338/328; 338/329; 338/330; 338/332

(58) Field of Classification Search ..... 219/463.8, 219/541–2, 544, 552–3; 338/240–1, 322–4, 338/326, 328–30, 332–3
See application file for complete search history.

(56) References Cited

U.S. PATENT DOCUMENTS

| | | | | |
|---|---|---|---|---|
| 4,161,648 | A | 7/1979 | Goessler | |
| 5,834,740 | A | 11/1998 | Wilde et al. | |
| 5,892,205 | A * | 4/1999 | Wilde et al. | 219/453.14 |

FOREIGN PATENT DOCUMENTS

| | | |
|---|---|---|
| EP | 0 871 346 | 4/1998 |
| EP | 1 011 296 | 10/1998 |
| EP | 1 229 763 | 1/2002 |
| EP | 1229763 | * 10/2002 |
| WO | WO 2004/066682 | 1/2004 |

* cited by examiner

*Primary Examiner*—Shawntina Fuqua
(74) *Attorney, Agent, or Firm*—Hoffman, Wasson & Gitler, P.C.

(57) ABSTRACT

A heater strip for use as a heating element in an electric heater is made up of a profiled strip made of a flat metallic material forming a resistor section and of mounting elements extending over one common longitudinal side and they are manufactured as one piece with the resistor section for mounting the heater strip to a support. The strip has a zigzag-shaped structure. The mounting elements are provided only on the flat leg sections of the zigzag-shaped heater strip.

7 Claims, 2 Drawing Sheets

FIG.1
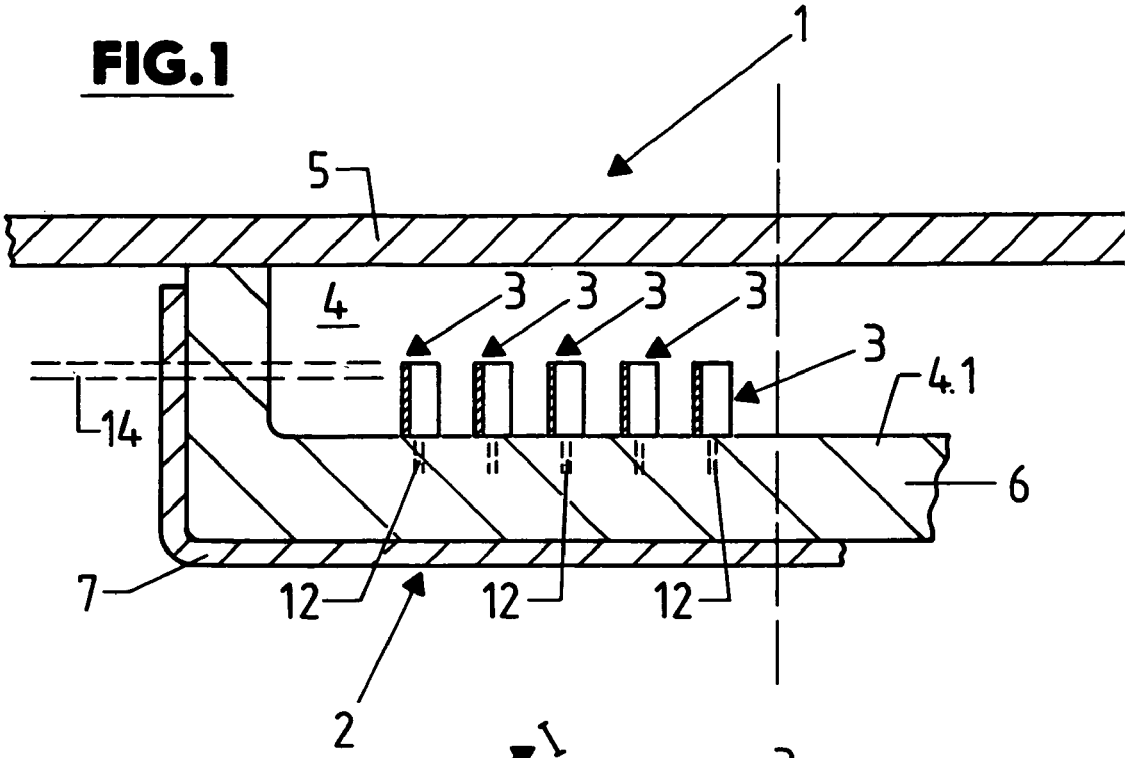
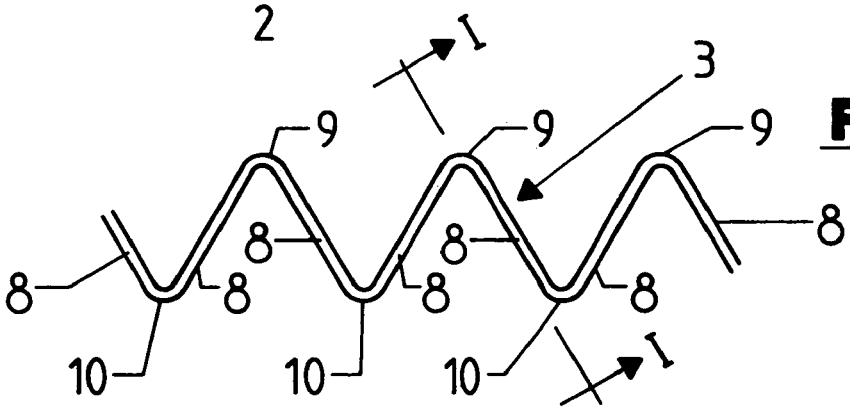
FIG. 2
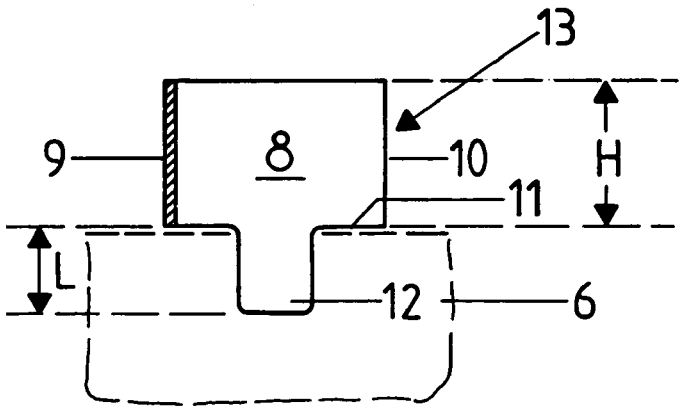
FIG. 3

HEATER STRIP FOR AN ELECTRIC HEATER, HEATER WITH SUCH A HEATER STRIP AND METHOD FOR MANUFACTURING THE HEATER STRIP

BACKGROUND OF THE INVENTION

The invention relates to a heater strip for use as a heating element in an electric heater or heating module, made as a profiled strip from a flat metallic material forming a resistor section and a plurality of mounting elements for mounting the heater strip to a support or base body, said mounting elements extending over one common longitudinal side of said resistor section and being made as one piece with the resistor section from the flat metallic material.

The invention also relates to an electric heater or heater module, especially also for use for electric heating panels and in particular for glass-ceramic panels, said heater including a base body made of an electrically conductive material and a heater strip provided upright on one surface side of the base body and made of a metallic strip material or starting material, which (heater strip) forms a strip-shaped resistor section that can be energized with a heating current and is fastened to the base body with mounting elements likewise made of the flat strip material and protruding over one common longitudinal side of the resistor section.

The invention further relates to a method for manufacturing the heater strip.

Electric heaters, especially for use for electric heating panels, in particular for glass-ceramic panels, are known in a wide variety of designs. Also known in the art (EP 0 590 315) is the use of a thin flat heater strip as an electric heating element that is energized with the heating current, which (heater strip) is fastened by means of molded mounting plate or elements on one surface side of a support or base body made of an electrically and thermally insulating material, i.e. oriented perpendicular or approximately perpendicular to the plane of the surface side of the base body. The heater strip is manufactured as one piece with the mounting elements from a starting material consisting of thin strip-shaped sheet metal that is suitable for heating elements, so that the mounting elements protrude over one common longitudinal side of a strip-shaped resistor section of the heater strip extending along the entire length of the heater strip. The strip is manufactured by suitable cutting of the strip-shaped starting material on one longitudinal side so that the mounting elements are retained or cut free during cutting. Afterwards, the heater strip is permanently shaped so that the longitudinal extension is sinusoidal. The majority of the successive mounting elements in the progression of the heater strip are located on at least one bend area of the undulation and therefore have a profile corresponding to the bend areas.

The known heater strip is characterized by considerable disadvantages. For example, the mounting elements are provided in the progression of the heater strip at relatively large intervals, in order to compensate for mechanical tensions during operation of the heater through elastic deformation of the heater strip resulting from different longitudinal expansion of the material of the base body and of the heater strip, which without compensation can result in damage to the base body and in particular also in separation of the heater strip from the base body.

A further disadvantage of the known heater strip is that during operation of the heater, successive sections along the heater strip have different temperatures, which can cause, for example, a perceptibly non-homogenous visual glow pattern of the heater strip. Furthermore, the areas of differing temperatures cause additional tensions in the heater strip. In addition, at a given heat output, the areas with a higher temperature are characterized by increased corrosion or oxidation, thus significantly reducing the overall service life of the heater or heating module.

An object of the invention is to provide for a heater strip that eliminates the disadvantages of the existing art, in particular ensuring an even visual heating pattern during operation of the heater, with increased service life and minimization of thermal tensions caused by differing thermal expansion.

SUMMARY OF THE INVENTION

The heater strip according to the invention is manufactured from a thin metal flat material (sheet metal) and has a zigzag profile, i.e. it is permanently bent in a multiple zigzag manner on axes oriented in the plane of the flat material and crosswise or perpendicular to the progression of the heater strip, preferably with flat or essentially flat leg sections between the bent areas or the bend areas of the zigzag-shaped profile. The material thickness of the flat metal material or of the heater strip is for example between 0.04 and 0.1 mm.

BRIEF DESCRIPTION OF THE DRAWINGS

The invention is described in more detail below based on an exemplary embodiment with reference to the drawings, wherein:

FIG. 1 shows a very simplified schematic partial view of a heater according to the invention, together with a glass-ceramic panel located above the heater;

FIG. 2 shows an enlarged depiction in top view of a partial length of the heater strip of the heater in FIG. 1;

FIG. 3 shows a cross section through the heater strip corresponding to line 1-1 of FIG. 2;

DETAILED DESCRIPTION OF THE INVENTION

Figure 4:
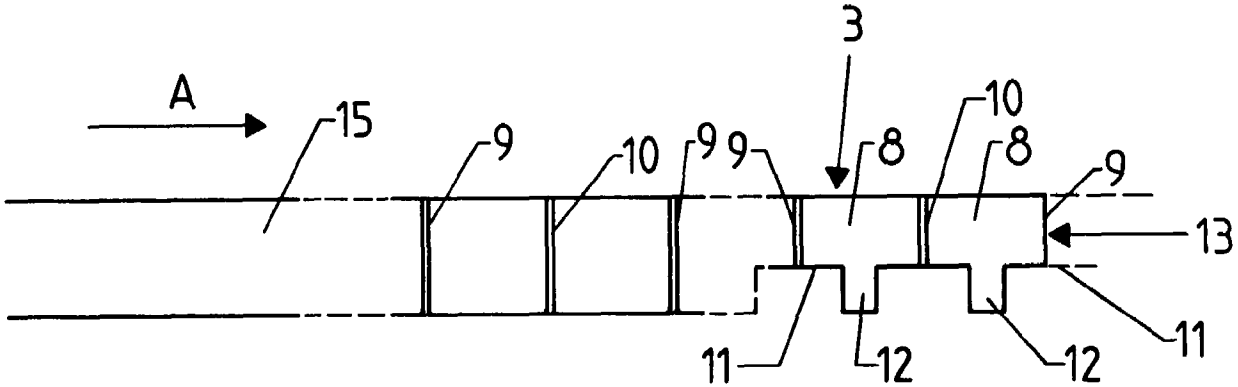
FIG. 4 shows a schematic representation of a partial length of the heater strip in FIGS. 2 and 3 during its manufacture.
Figure 5:
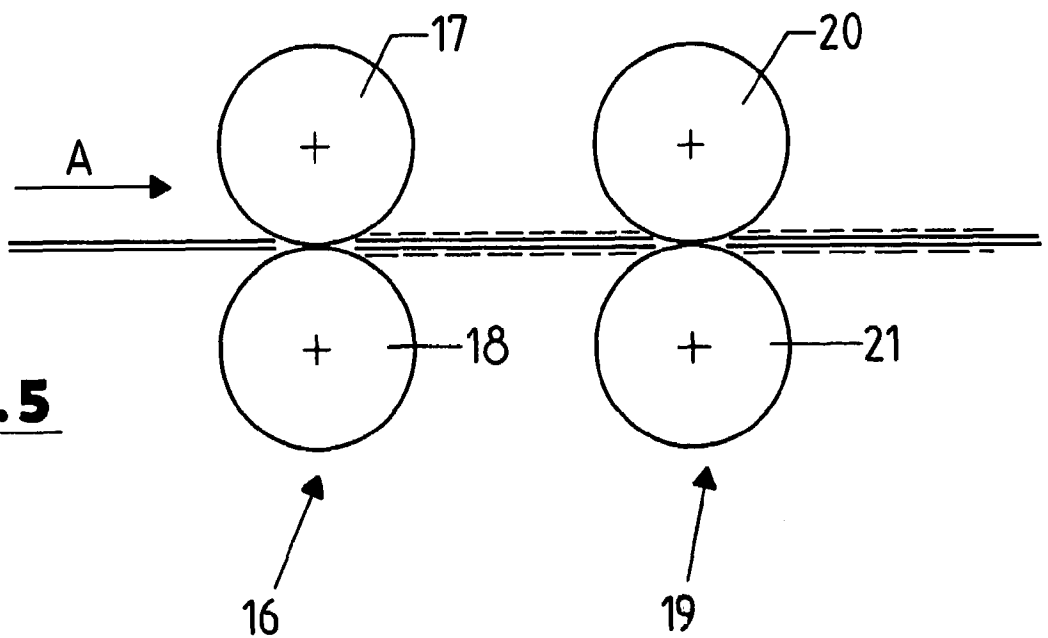
FIG. 5 shows a schematic representation of a device for manufacturing the heater strip in FIGS. 2 and 3.

The electric heater generally designated 1 in the drawings consists in the known manner of a trough-shaped base body 2 that is open at the top and of a heater strip 3, which is located upright on the bottom 4.1 of the recess 4 of the base body 2, in a progression with a plurality of turns, so that the heater strip 3 extends as evenly as possible over the entire surface of the bottom 4.1, which is circular for example, thus achieving an even distribution of the thermal output over the effective heating surface during operation of the heater 1. The base body 2 is closed on the top by a panel 5 forming the cooktop surface of an electric stove and made of an electrically insulating material, for example glass-ceramic.

In detail, the base body 2 consists of an inner, trough-shaped support or base body element 6 forming the recess 4 and made of an electrically and thermally insulating material with sufficiently high thermal stability and of an outer housing or base body element 7 made of metal, with which the heating module 1 can be mounted on a support construction of an electric stove not depicted.

The heater strip 3 manufactured from a thin flat metal material (sheet metal) that is suitable for such heater strips so that the heater strip 3, as clearly depicted in FIGS. 2 and 3, is permanently and non-resiliently bent or profiled in a zigzag manner on axes perpendicular to its longitudinal extension, with essentially straight or essentially flat strip sections 8 between two outer rounded bend areas 9 and 10 of the zigzag profile.

In the depicted embodiment the heater strip 3 is provided in the center of each leg section 8, i.e. at the same distance respectively from the adjacent bend areas 9 and 10, with mounting elements 12 as one piece protruding over one common longitudinal border or one common longitudinal edge 11, each of which (mounting elements) is flat, just as the corresponding leg section 8. The heater strip thus forms a continuous strip-shaped resistor section 13 with the longitudinal edge 11 and mounting section consisting of a plurality of mounting elements 12.

With the mounting elements 12, which are provided only on the leg sections 8, the heater strip 3 is fastened upright in the bottom 4.1 so that the planes of the leg sections 8 are oriented perpendicular or essentially perpendicular to the plane of the bottom 4.1. For this purpose, the mounting elements 12 engage in the material of the base body element 6 and are anchored there in a suitable manner, so that the longitudinal edge 11 lies in the plane of the bottom 4.1, or that the longitudinal edge 11 is at a slight distance from the plane of the bottom 4.1, or that the resistor section 13 of the heater strip 3 along the longitudinal edge 11 is slightly embedded in the material of the base body element 6.

Perpendicular to the progression of the heater strip 3 the resistor section 13 has a width or height H and the mounting elements 12 a length L that in the depicted embodiment is smaller than the width H, but in any case considerably smaller than the material thickness of the insulating base body element 6 in the area of the bottom 4.1. The width B of the mounting elements 12 is smaller than the length of the respective leg section 8 and in the depicted embodiment is approximately one-third the length of the corresponding leg section 8.

The zigzag profiled heater strip 3 divided into a plurality of bends on the bottom 4.1 is connected at both ends with connecting electrodes 14, by which the heating current is supplied during operation of the heater, so that the heater strip 3 is operated within a visible spectral range.

The heater strip 3 is evenly profiled along its entire length, i.e. the leg sections 8 all have the same length. Preferably the heater strip 3 is mounted on the base body 2 so that the successive mounting plates or elements 12 in the longitudinal direction of the heater strip are at the same distance from each other.

The described design of the heater strip, i.e. the zigzag-shaped profiling, the positioning of each of the mounting elements 12 in the center of a leg section 8 and only on these leg sections 8, and the flat and relatively narrow design of the mounting elements 12, also in comparison to the height H of the resistor section 13 achieves, during switching of the heater 1 on and off and during operation of the heater, an even distribution of temperature along the heater strip 3 and in particular also an even, homogenous visual glow pattern, without visually perceptible differences in brightness within the leg sections 8 and the adjacent bend areas 9 and 10.

This even temperature distribution is due in particular to the fact that the mounting elements 12 are not distributed at random on the heater strip 3, but rather exactly in the center of the respective leg section 8, and that the mounting elements 12 are relatively narrow, in particular also in comparison with the height H of the resistor section 13. The narrow design of the mounting elements 12 alone means that there is no significant change in the resistance value or in the resistance profile along the heater strip 3 and no significant diffusion of heat from the resistor section 13 to the base body element 6. Due to the location of the mounting elements 12 in the center of each leg section 8 and therefore in the center of the zigzag-shaped heater strip 3, any slight loss of heat at the mounting elements 12 from the outside, i.e. from the bend areas 9 and 10, are fully compensated, resulting in the above-mentioned constant temperature profile and in particular also in the homogenous visual glow pattern.

Mounting of the heater strip 3 on the base body 2 at each leg section 8 with one mounting element 12 ensures the reliable anchoring of the heater strip 3 to the base body, i.e. there is a highly stable connection between the heater strip 3 and the base body 2. The even distribution of temperature along the heater strip 3 and the prevention of hot and cold areas eliminates thermally related tensions within the heater strip and therefore also the danger of corrosion or oxidation at especially hot areas of the heater strip, so that the service life of the heating module 1 is increased significantly through the design according to the invention.

The materials used for the heater strip 3 and the base body 2 and the base body element 6 have widely varying heat expansion coefficients, so that the relatively high temperature during operation of the heater 1 can cause different length expansions between the base body 2 and the heater strip 3, which (length expansions) can easily be compensated by the zigzag shape of the heater strip 3 and the location of the mounting elements 12 only in the center of the leg sections 8, through a slight elastic deformation in the rounded bend areas 9 and 10, with no significant increase in mechanical tensions. Thermally related tensions that could damage the base body 2 and in particular also that could cause the heater strip 3 to become separated from the base body 2 are therefore effectively prevented.

As described above, one essential feature of the invention is that the mounting elements 12 are not provided at random on the heater strip 3, but only on the flat or essentially flat leg sections 8 and therefore likewise have a flat or essentially flat design. This can be achieved for example with the manufacturing method for the measuring strip schematically depicted in FIGS. 3 and 4.

For the manufacture of the heater strip 3, a thin metallic strip-shaped flat starting material 15 (sheet metal) is used accordingly, with a width that is equal to the sum of H and L and which can be taken continuously from a supply or a roll during manufacturing and profiled in a processing station 16. The processing station 16 consists essentially of two contra-directional driven gearwheel-like profiling wheels 17 and 18, which form a working or profiling gap in the area of their engaging teeth or intertooth space, through which (gap) the strip-shaped starting material 15 is fed, so that after the processing station 16 in transport direction A it has an even zigzag profiling along the entire length of the heater strip.

In a processing station 19 following the processing station 16 in transport direction A, the mounting elements 12 are punched out or cut out of the strip-shaped starting material 15. For this purpose, the processing station 19 features two gearwheel-like wheels or rollers 20 and 21, which form a guide and alignment gap with their engaging teeth and intertooth space, through which (gap) the profiled starting material 15 is fed, aligned in relation to its profiling. The wheels 20 and 21 also form the cutting tools for cutting or punching out the mounting elements 12.

Since the flat starting material 15 is exactly aligned with its profiling relative to the angular position of the wheels 20 and 21, it is also possible to cut out the mounting elements 12 from the flat starting material 15 using the cutting tools provided on these wheels, each one exactly in the center of one leg section 8.

A measuring device not depicted can measure the relative resistance for each length unit of the flat starting material 15, for example by measuring the electric resistance between two areas at a distance from each other in the longitudinal direction of the starting material 15. The measured resistance value is compared with a set value stored in an electronic measuring and control unit, so that when the mounting elements 12 are cut out in the processing station 19, the width or height H of the resistor section 13 can be varied to produce the required resistance value for each length unit of the resistor section 13, while maintaining the even zigzag-shaped profiling.

The invention was described based on one exemplary embodiment. It goes without saying that numerous modifications and variations are possible without astriponing the underlying inventive idea upon which the invention is based.

REFERENCE LIST

1 heater or heating module
2 base body
3 heater strip
4 recess or aperture in base body 2
4.1 bottom
5 panel
6, 7 base body element
8 leg section
9, 10 bend area
11 longitudinal edge
12 mounting element or mounting plate
13 resistor section
14 connecting electrode
15 strip-shaped starting material
16 processing station
17, 18 profiling wheels or roller
19 processing station
20, 21 guide and alignment wheel with cutting or punching tool

What is claimed is:

1. A method for manufacturing a heater strip to be used as a heating element in an electric heater or heating module comprising:

providing a support or base body, forming the heater strip as a profiled strip from a metallic material forming a resistor section, forming a plurality of mounting elements for mounting the heater strip onto the support or base body, wherein said mounting elements extending over one common longitudinal side of said resistor section and being made as one piece with the resistor section form the flat metallic material, the strip is formed in a zigzag structure with leg sections between bend areas of the zigzag form such that the mounting elements are provided only on the leg sections, and the mounting elements are formed on one longitudinal side of the resistor section by cutting or punching from the metallic starting material in a cutting or punching station positioned exactly to the zigzag-shaped profiling and positioned exactly to the leg sections.

2. The method as claimed in claim 1, wherein the profiling of the starting material takes place in a continuous process, for example using two profiling wheels or rollers that are gearwheel-like on their outside circumference and that form a processing or profiling gap with their engaging teeth and intertooth space, through which the starting material is fed.

3. The method as claimed in claim 1, wherein the cutting of the starting material for forming the mounting elements takes place during profiling of the material.

4. The method as claimed in claim 3, wherein the profiling tool is simultaneously designed as a cutting or punching tool for cutting out the mounting elements.

5. The method as claimed in claim 1, wherein a cutting tool is used for manufacturing the mounting elements in which the already profiled starting material is positioned exactly with its profiling.

6. The method as claimed in claim 5, wherein the cutting tool consists of at least two gearwheel-like and contradirectional revolving driven wheels or rollers, which form a transport gap accommodating the starting material in the area of their engaging teeth and intertooth space and which are driven synchronously with cutting tools in opposing directions of rotation.

7. The method as claimed in claim 1, wherein the starting material is a strip-shaped starting material.

* * * * *